US005311689A

United States Patent [19]

Lindsey

[11] Patent Number: 5,311,689

[45] Date of Patent: May 17, 1994

[54] PERSONAL MEMO DEVICE

[76] Inventor: Ellen H. Lindsey, 12 Greymore, Chesterfield, Mo. 63017

[21] Appl. No.: 739,412

[22] Filed: Aug. 2, 1991

[51] Int. Cl.[5] ..... A44C 5/00

[52] U.S. Cl. ..... 40/633; 283/81; 224/267

[58] Field of Search ..... 40/633, 665, 310; 63/1.1; 281/106; 283/42, 45, 81

[56] References Cited

U.S. PATENT DOCUMENTS

| | | | |
|---|---|---|---|
| 1,407,239 | 2/1922 | Weiss | 40/489 X |
| 1,899,284 | 2/1933 | Manhard | 40/310 |
| 1,999,011 | 4/1935 | Wasser | 40/310 |
| 2,221,761 | 11/1940 | Fairbanks | 40/310 |
| 3,660,916 | 5/1972 | McDermott et al. | 40/633 |
| 4,612,718 | 9/1986 | Golub et al. | 40/633 |
| 4,682,431 | 7/1987 | Kowalchuk | 40/633 |
| 4,991,337 | 2/1991 | Solon | 40/633 |
| 5,026,084 | 6/1991 | Pasfield | 40/633 X |

FOREIGN PATENT DOCUMENTS

| | | | |
|---|---|---|---|
| 1227497 | 4/1971 | United Kingdom | 40/633 |

*Primary Examiner*—Kenneth J. Dorner
*Assistant Examiner*—J. Bonifanti
*Attorney, Agent, or Firm*—Armstrong, Teasdale, Schlafly & Davis

[57] ABSTRACT

A personal memo device adapted to be worn around the wrist. The device is made from a flexible sheet-like material and has a message-receiving portion upon which a message can be written and wrist straps extending from opposite sides of the message receiving portion. The free ends of the wrist straps can be secured together with adhesive or with interlocking hooks formed in the straps to secure the device around the user's wrist. The device may also be provided with a confidentiality flap that can be folded over the message-receiving portion to conceal a message written thereon. The devices are preferably provided in a pad.

6 Claims, 2 Drawing Sheets

PERSONAL MEMO DEVICE

BACKGROUND OF THE INVENTION

This invention relates to making notes and reminders, and in particular to a personal memo device which allows the user to wear a note or memo on the wrist as a reminder.

Various types of memo pads and other devices have been made to help people remember important information, such as events, errands, etc. However, notes tucked in one's pocket are easily forgotten as are messages written on a calendar, organizer, or memo board. The proverbial string tied around a finger may be less easily forgotten, but it does not give the wearer detailed information. What has been needed is a convenient, easy to use device that provides the user with a note or reminder, and which cannot be lost or forgotten by the user, but is relatively inconspicuous to others.

SUMMARY OF THE INVENTION

The personal memo device of the present device is adapted to be worn around the wrist to provide the user with important information and/or serve as a reminder. The personal memo device is made from a flexible, sheet-like material, preferably paper. Generally, the device comprises a message-receiving portion upon which a message can be written. Wrist straps, narrower than the message-receiving portion, extend from opposite sides of the message-receiving portion. The device further comprises means for securing the free ends of the wrist straps together to secure the device around the user's wrist.

The securing means may be releasable or permanent, and may constitute an adhesive, for example a pressure sensitive adhesive that allows the straps to be secured simply by pressing the straps together, or a wetable adhesive that allows the straps to be secured simply by licking the adhesive and pressing the straps together. Alternatively, the securing means could comprise interlocking hooks formed in the ends of the wrist straps by diagonal cuts extending inward from opposite edges of their respective straps. Of course some other means for securing the straps could also be used.

The personal memo device may be provided with a confidentiality flap adapted to be folded over the message-receiving portion to conceal any message written thereon. There is preferably some means for releasably securing the flap in its folded configuration. This securing means may be some type of adhesive, preferably a pressure-sensitive adhesive or wetable adhesive. However, some other securing means could be used, for example one of the flap and the message-receiving portion could be provided with a tab adapted to fit in a slot on the other of the flap and the message-receiving portion. Of course, some other means for securing the flap could be used.

The devices are preferably provided in a pad, in which a plurality of the devices are aligned and releasably secured together for convenient storage and dispensing. The adhesive used for either securing the wrist straps or the flap can be used to releasably secure the devices together in the pad. The devices can be made in different colors, and assembled in multi-colored pads.

The personal memo device of the present invention is of simple construction, and can be inexpensively made, for example by die cutting. The device can be conveniently and comfortably worn around the wrist to provide an effective yet unobtrusive reminder, or simply to keep an item of information readily available. The device can be easily secured around the user's wrist with adhesive, or by using interlocking hooks formed in the straps. A security flap can be provided to cover the information written on the device. The device can be made in colors, and provided with decorations, if desired, to make them more attractive. These and other features and advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENTS

Figure 1:
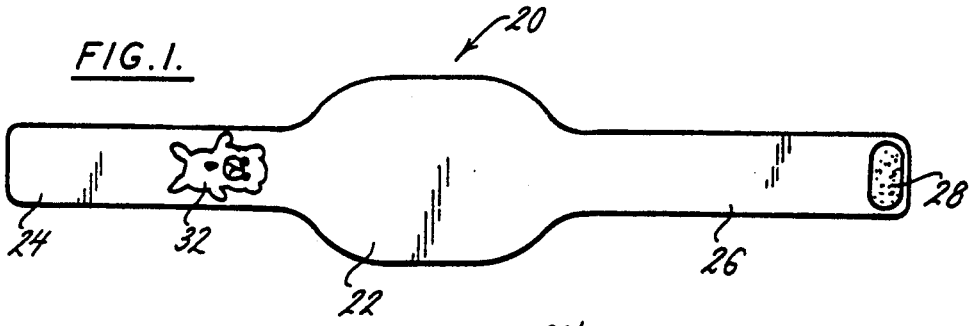
FIG. 1 is a plan view of a first embodiment of a personal memo device constructed according to the principles of the present invention.

A first embodiment of a personal memo device constructed according to the principles of this invention is indicated generally as 20 in FIG. 1. The device 20 is adapted to be worn around the wrist of the user to keep information handy or to serve as a reminder. The device 20 is made from a flexible, sheet-like material. For simplicity and economy the device 20 is preferably made of paper. The device 20 could also be made of plastic, in which case the device 20 could be reusable. If the device 20 is made of plastic, suitable surface treatment can be provided so that the device could be easily written on. The device 20 be white, but is preferably colored.

The device 20 comprises a message-receiving portion 22 upon which a message can be written, preferably in either pen or pencil. The message-receiving portion 22 preferably has rounded edges so that it does not scratch the wearer or snag on clothing. The message-receiving portion is preferably about the size of the top of the user's wrist. The message receiving portion shown in the Figures is generally oval, but it should be understood that it could be any shape, including in the shape of some object, such as a star, or an animal such as an elephant. Wrist straps 24 and 26, which are narrower than the width of the message-receiving portion 22, extend from opposite sides of the message-receiving portion.

Figure 2:
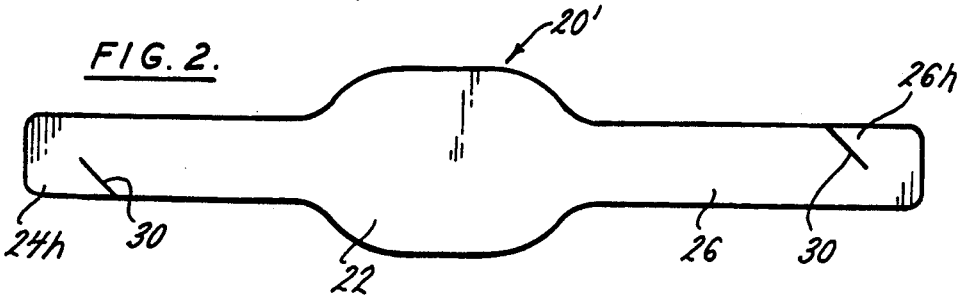
FIG. 2 is a plan view of an alternate construction of the first embodiment of the personal memo device, with interlocking hooks for securing the device.
Figure 3:
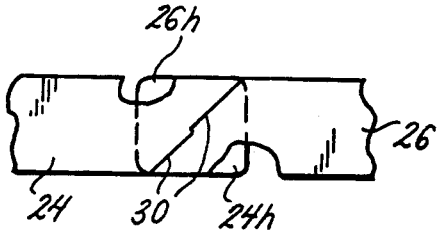
FIG. 3 is a plan view of the alternate construction of the first embodiment, with the interlocking hooks engaged.

The device 20 includes some means for securing the free ends of the wrist straps 24 and 26 together, to secure the device on the user's wrist. The securing means is preferably a patch 28 of adhesive on one or both of the straps 24 and 26. This adhesive can be a pressure sensitive type so that the straps can be secured simply by pressing the straps together. The adhesive could also be a wetable type so that the straps can be secured by licking or otherwise wetting the adhesive and pressing the straps together. In an alternate construction 20' of the first embodiment, shown in FIG. 2, the securing means can comprise interlocking hooks *24h* and *26h* formed in the straps 24 and 26, respectively. The hooks are formed by diagonal cuts 30 extending inwardly from the edges of the strap at an angle of about 45° with respect to the longitudinal axes of the straps. The cuts 30 extend inwardly from opposite edges of their respective straps, so that the hooks mate, as shown in FIG. 3.

Decorative matter 32 can be provided on the message-receiving portion 22 and/or the straps 24 and 26.

Figure 4:
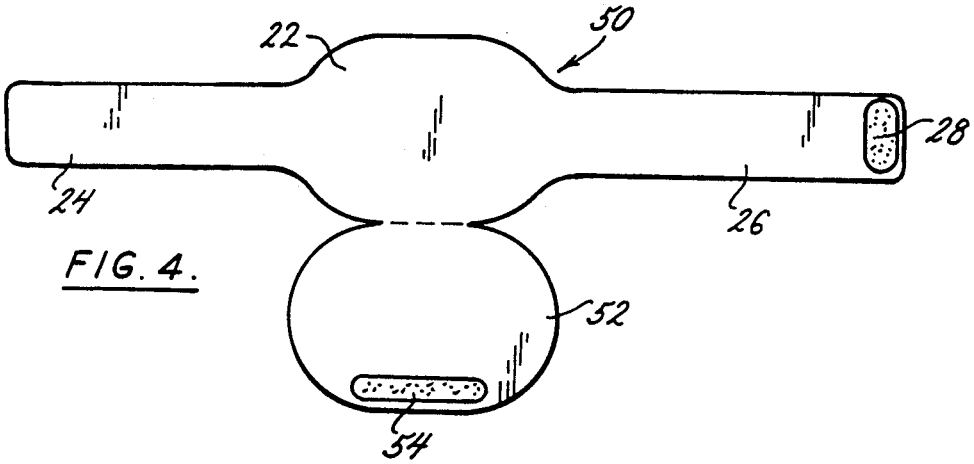
FIG. 4 is a second embodiment of a personal memo device constructed according to the principles of the present invention, with a flap for covering the message-receiving portion of the device.
Figure 5:
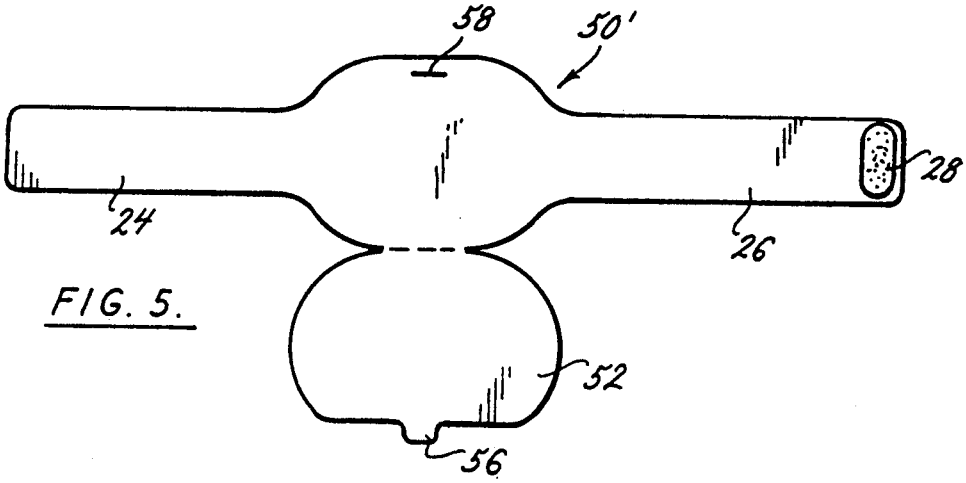
FIG. 5 is an alternate construction of the second embodiment of the personal memo device, with an interlocking tab and slot for securing the flap.
Figure 6:
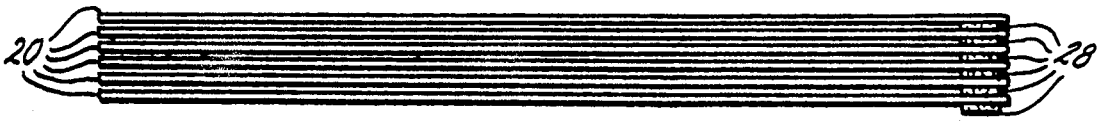
FIG. 6 is a side elevation view of a pad of personal memo devices constructed according to the principles of this invention.

A second preferred embodiment of a personal memo device is indicated generally as 50 in FIG. 4. The device 50 of the second preferred embodiment is generally similar to the device 20 of the first preferred embodiment, and corresponding parts are identified with corresponding reference numerals. However, device 50, unlike device 20, has a security flap 52 which can be folded over the message-receiving portion 22 so that any message written thereon is not readily visible to others. The flap 52 preferably is of the same size and shape as the message-receiving portion 22. Decorative matter 32 can be provided on the top of the flap 52, to make the device more attractive, and conceal the purpose of the device. The device 50 preferably includes some means for releasably securing the flap 52 over the message-receiving portion 22. The securing means is preferably a patch 54 of adhesive on either the message-receiving portion 22 or on the flap 52. This adhesive is preferably a pressure sensitive adhesive so that the flap 52 can be secured to the message-receiving portion simply by pressing them together. The adhesive could also be a wetable adhesive, in which case the flap can be secured to the message-receiving portion simply by licking or otherwise wetting the adhesive and pressing the flap and the message-receiving portion together. The pressure sensitive adhesives allows the flap to reclosed several times. In the alternate construction 50' shown in FIG. 5, the securing means comprises a tab 56 on the flap 52 that is adapted to interlock with a slot 58 on the message-receiving portion. Of course the locations of the tab and slot could be switched, if desired.

The personal memo devices 20, 20', 50 and 50' can be die cut, and are preferably stacked and assembled into pads for convenient use, by releasably securing the devices together. The means for releasably securing the pads together can be the pressure sensitive adhesive for securing the wrist straps together, or even the pressure sensitive adhesive for securing the flap over the message receiving-portion. The personal memo devices 20, 20', 50, and 50' can be made in a variety of colors, and the pads can include an assortment of different colors.

OPERATION

The personal memo devices 20, 20', 50 and 50' are very easy to use. The can be easily secured about the wrist where they provide comfortable and convenient access to a note or reminder, without being obtrusive. The personal memo device is ideal for providing reminders to school children, or to others.

With the devices 20 or 20', the user simply writes a note or a reminder on the message-receiving portion 22, removes the device 20 or 20' from the pad, and wraps the straps 24 and 26 around the wrist, and secures the ends. With the device 20 this is quickly and easily done by pressing the straps together, if the device has pressure sensitive adhesive, or licking the adhesive spot and pressing the straps together of the device has a wetable adhesive. With the device 20', the hooks *24h* and *26h* are simply interlocked.

With the devices 50 or 50', the user likewise simply writes a note or reminder on the message-receiving portion 22 and removes the device 50 or 50' from the pad. The user then folds the flap 52 over the message-receiving portion, and secures it. With the device 20 this is quickly and easily done by pressing the flap and the message-receiving portion together, if the device has pressure sensitive adhesive, or licking the adhesive spot and pressing the flap and message-receiving portion together if the device has a wetable adhesive. With the device 50', the tab 54 is inserted into the slot 56. The device 50 or 50' is then secured on the wrist as described above with respect to devices 20 and 20'.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limited sense.

What is claimed is:

1. A personal memo device adapted to be worn around the wrist, the memo device being made from a single sheet of a flexible sheet-like material and comprising a message-receiving portion upon which a message can be written, a flap adapted to be folded over the message-receiving portion to conceal a message written thereon, means for releasably securing the flap in its folded over configuration comprising adhesive on at least one of the flap and the message-receiving portion, wrist straps extending from opposite sides of the message-receiving portion, and means for securing the free ends of the wrist straps together to secure the device around the use's wrist.

2. A personal memo device adapted to be worn around the wrist, the memo device being made from a single sheet of a flexible sheet-like material and comprising a message-receiving portion upon which a message can be written, a flap adapted to be folded over the message-receiving portion to conceal a message written thereon, means for releasably securing the flap in its folded over configuration comprising a tab on one of the flap and the message-receiving portion, and a slot for receiving the tab on the other of the flap and message-receiving portion, wrist straps extending from opposite sides of the message-receiving portion, and means for securing the free ends of the wrist straps together to secure the device around the use's wrist.

3. A pad of personal memo devices, the pad comprising a plurality of personal memo devices stacked one on top of the other and releasably secured together at one of their respective ends, each personal memo device being made from a flexible sheet-like material and comprising a message-receiving portion upon which a message can be written, a flap adapted to be folded over the message-receiving portion to conceal a message written thereon, means for releasably securing the flap in its folded-over configuration, wrist straps, extending from opposite sides of the message receiving portion, and means for securing the free ends of the wrist straps together to secure the device around the user's wrist.

4. The pad according to claim 3 wherein the means for releasably securing the flap comprises adhesive on at least one of the flap and the message-receiving portion.

5. The pad according to claim 4 wherein the means for releasably securing the flap comprises a tab on one of the flap and the message-receiving portion, and a slot for receiving the tab on the other of the flap and the message-receiving portion.

6. A pad of a plurality of personal memo devices, each device including a message-receiving portion with wrist straps extending from opposite sides thereof, means for securing the ends of the wrist straps, a flap which may be folded over the message-receiving portion, and a means for releasably securing the flap in a folded-over position, each personal memo device being releasably secured to the other personal memo devices to form the pad.

* * * * *